US006963717B1

(12) United States Patent
Klimley et al.

(10) Patent No.: US 6,963,717 B1
(45) Date of Patent: Nov. 8, 2005

(54) FUSER STRIPPER BAFFLE AND A PRINTING MACHINE INCLUDING THE SAME

(75) Inventors: William R. Klimley, Rochester, NY (US); Thomas C. Keyes, Fairport, NY (US); Scott Martin, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/996,111

(22) Filed: Nov. 23, 2004

(51) Int. Cl.[7] ..... G03G 15/20

(52) U.S. Cl. ..... 399/323; 271/311; 271/900

(58) Field of Search ..... 399/124, 279, 399/323, 283, 320; 271/900, 311

(56) References Cited

U.S. PATENT DOCUMENTS 6,782,228 B1 * 8/2004 Rasch et al. ..... 399/323

* cited by examiner

*Primary Examiner*—David Gray
*Assistant Examiner*—Laura K. Roth
(74) *Attorney, Agent, or Firm*—Wayne J. Egan

(57) ABSTRACT

A fuser stripper baffle exit minimizes differential gloss marks due to paper contacting the fuser exit baffle. Portions of paper that touch the baffle cool differently than portions that don't, resulting in differential gloss in the paper path or spanwise direction. The exit baffle contains a series of axial-direction steps or plateaus in its upper surface, such that the highest step is nearest the fuser roll, while the lowest plateau is furthest from the roll. This reduces the surface area of the fuser stripper baffle exit that contacts the surface of the paper sheet as the paper sheet is stripped from the fuser roll. The paper thus touches the exit baffle for the minimum amount of time, thus minimizing the heat transfer to the baffle. This minimizes differential cooling effects which, in turn, minimizes differential gloss.

8 Claims, 5 Drawing Sheets

FUSER STRIPPER BAFFLE AND A PRINTING MACHINE INCLUDING THE SAME

BACKGROUND OF THE INVENTION

It is known to arrange a xerographic printing machine with a retracting stripper baffle to strip the body of the paper sheet from the fuser roll. This baffle, when cold, can cause differential gloss marks on the print between the solid baffle areas and the areas where the stripper fingers need to penetrate through the baffle. This differential gloss is caused mostly by the heat transfer from the hot image disposed on the paper sheet to the colder baffle surface.

Thus, there is a need for an improved fuser stripper baffle.

SUMMARY OF THE INVENTION

In a first aspect of the invention, there is described a fuser stripper baffle comprising a multiplicity of protruding fingers, the multiplicity of fingers arranged to strip a paper sheet from a proximate fuser roll, each finger of the multiplicity of fingers forming a protruding distal stripping end and an adjacent upper distal end stripping surface, the distal end stripping surface forming a multiplicity of stepped surfaces, the multiplicity of stepped surfaces extending in an axial direction with respect to an included spanwise direction.

In a second aspect of the invention, there is described a printing machine including a fuser stripper baffle, the fuser stripper baffle comprising a multiplicity of protruding fingers, the multiplicity of fingers arranged to strip a paper sheet from an included proximate fuser roll, each finger of the multiplicity of fingers forming a protruding distal stripping end and an adjacent upper distal end stripping surface, the distal end stripping surface forming a multiplicity of stepped surfaces, the multiplicity of stepped surfaces extending in an axial direction with respect to an included spanwise direction.

DETAILED DESCRIPTION OF THE INVENTION

Briefly, a fuser stripper baffle exit minimizes differential gloss marks due to paper contacting the fuser exit baffle. Portions of paper that touch the baffle cool differently than portions that don't, resulting in differential gloss in the paper path or spanwise direction. The exit baffle contains a series of axial-direction steps or plateaus in its upper surface, such that the highest step is nearest the fuser roll, while the lowest plateau is furthest from the roll. This reduces the surface area of the fuser stripper baffle exit that contacts the surface of the paper sheet as the paper sheet is stripped from the fuser roll. The paper thus touches the exit baffle for the minimum amount of time, thus minimizing the heat transfer to the baffle. This minimizes differential cooling effects which, in turn, minimizes differential gloss.

Figure 1:
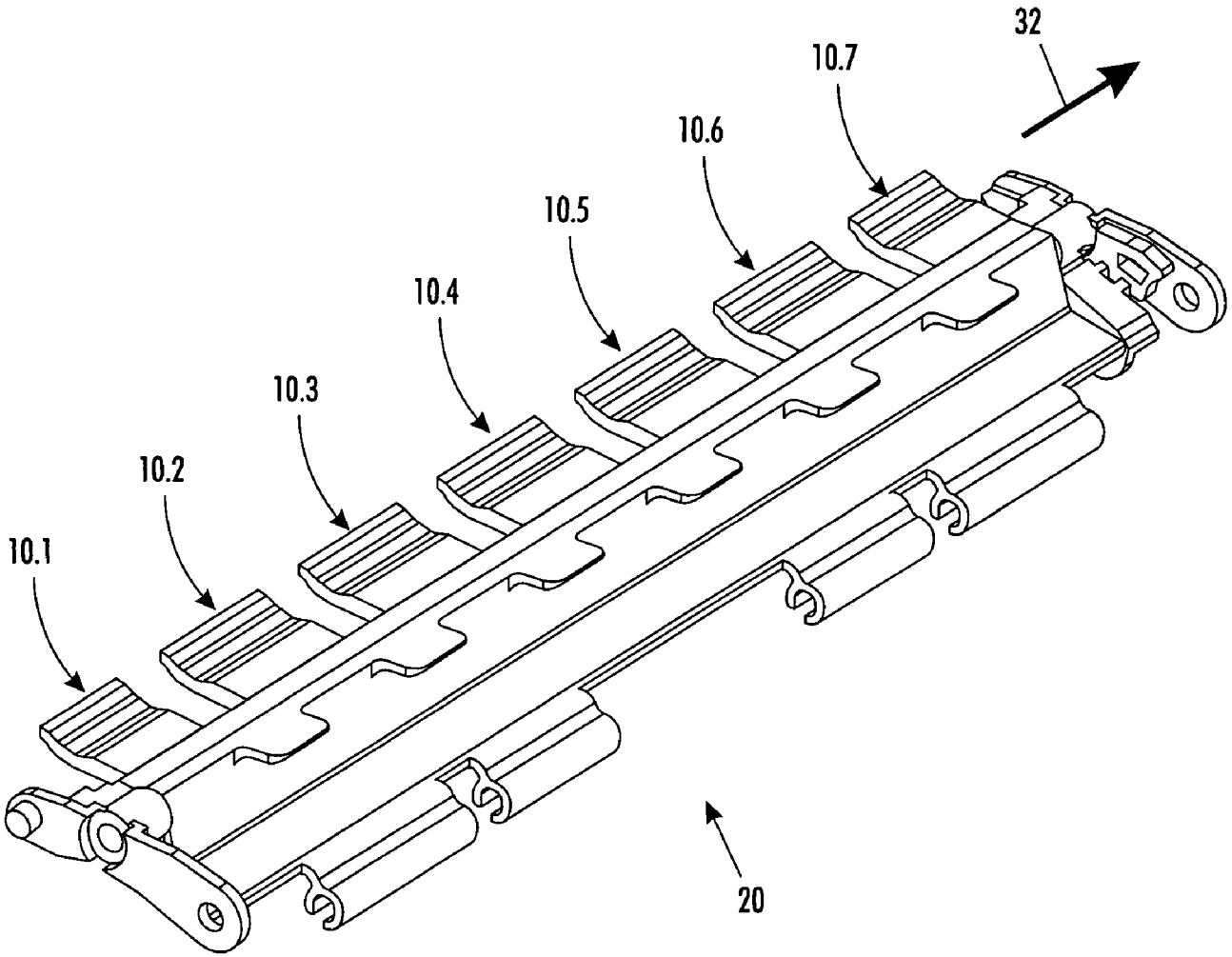
FIG. 1 is a detached elevated perspective view of one embodiment of a fuser stripper baffle 20, in accordance with the present invention. As shown, the baffle comprises a multiplicity of N individual protruding baffle fingers respectively numbered 10.1 through 10.7.

Referring now to FIG. 1, there is shown one embodiment of a detached elevated perspective view of a fuser stripper baffle 20, in accordance with the present invention. As shown, the baffle comprises a multiplicity of N individual protruding baffle fingers wherein the N individual fingers are respectively numbered 10.1, 10.2, 10.3, 10.4, 10.5, 10.6 and 10.7.

Figure 2:
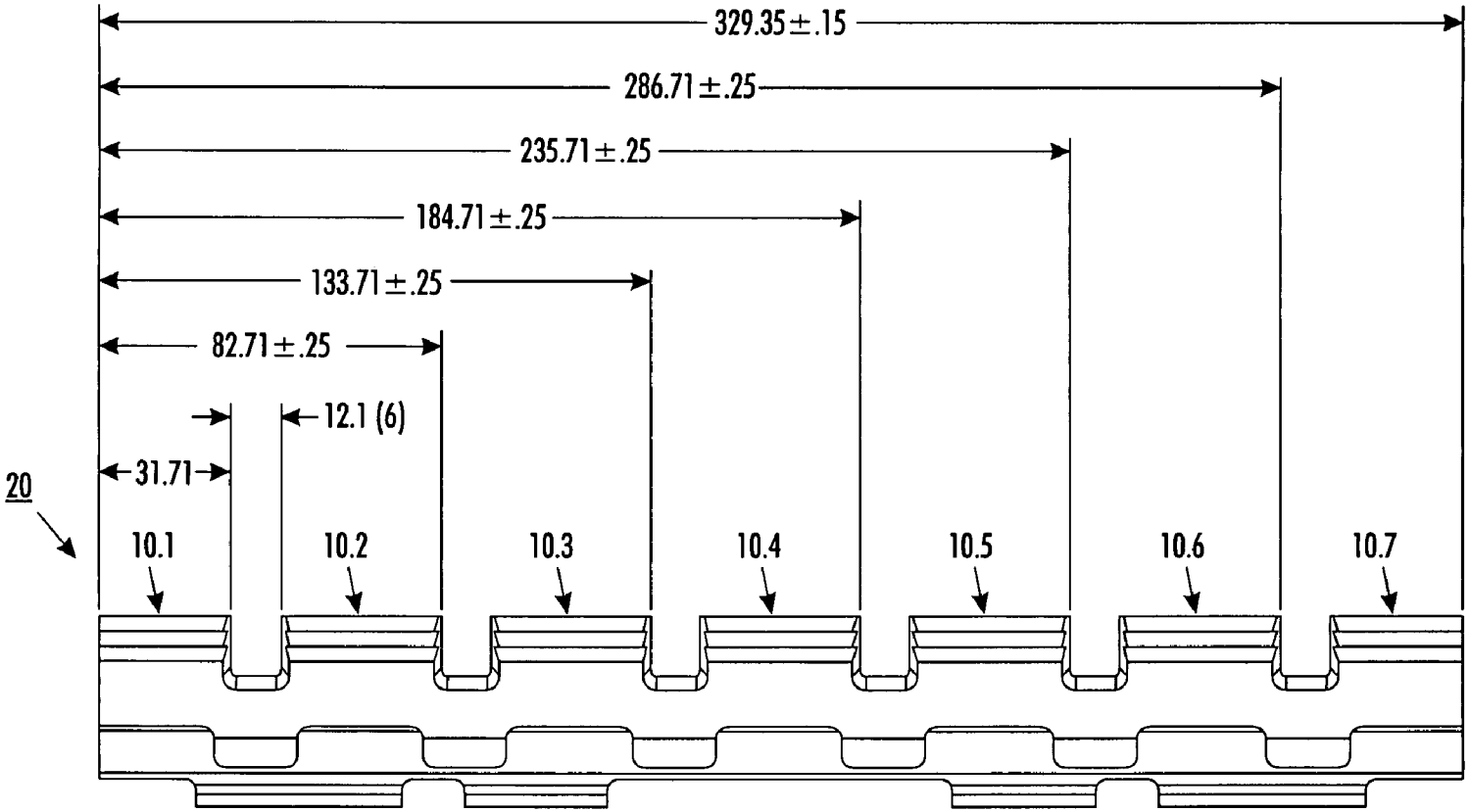
FIG. 2 is an elevated top-down view of the fuser stripper baffle 20 of FIG. 1. All dimensions are expressed in millimeters ("mm").

Referring now to FIG. 2, there is an elevated top-down view of the fuser stripper baffle 20 of FIG. 1.

Figure 3:
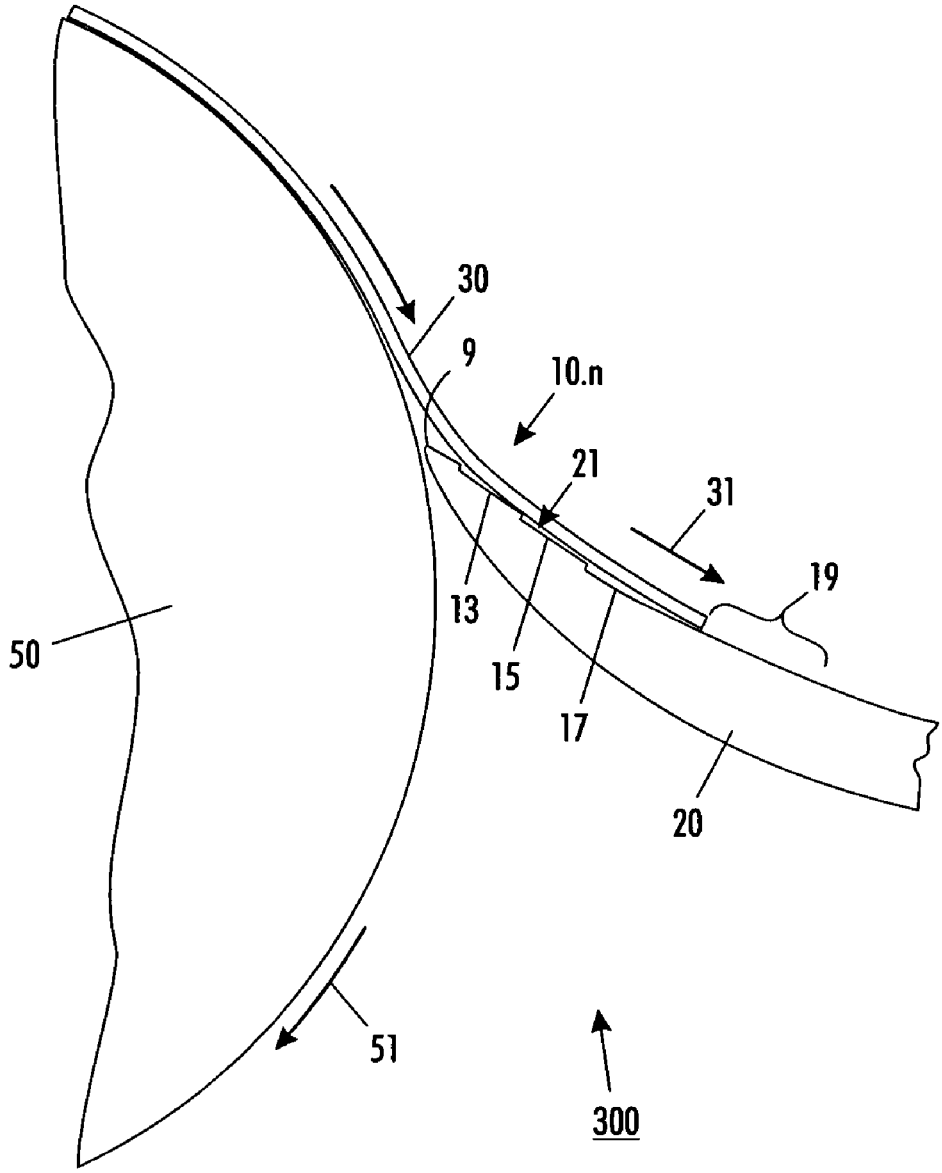
FIG. 3 is a cutaway profile view of the fuser stripper baffle 20 of FIG. 1 arranged to strip the body of a sheet of paper 30 from a proximate fuser roll 50. There is depicted a typical baffle finger **10.*n* of the multiple baffle fingers 10.1 through 10.7. The arrangement of the fuser stripper baffle 20 and the fuser roll 50 is depicted by reference number 300**.

Referring now to FIG. 3, there is a cutaway profile view of the fuser stripper baffle 20 of FIG. 1 arranged to strip the body of a sheet of paper 30 from a proximate fuser roll 50. A typical baffle finger of the multiple baffle fingers 10.1 through 10.7 is depicted as reference number **10.*n*. In one embodiment, the fuser stripper baffle 20 comprises exactly 7 individual baffle fingers 10.*n* and thus the value of the parameter "n" in reference number 10.*n*** varies from 1 to 7.

Still referring to FIG. 3, the arrangement of the fuser stripper baffle 20 and the fuser roll 50 is depicted by reference number 300.

As shown, the baffle finger **10.*n* is arranged to strip a paper sheet 30 from a proximate fuser roll 50. The finger 10.*n* forms a protruding distal stripping end 9 and an adjacent upper distal end stripping surface 21. The distal end stripping surface 21 forms a multiplicity of three (3) stepped surfaces or plateaus respectively numbered 13, 15 and 17. With cross-reference to FIG. 1, the multiplicity of stepped surfaces 13, 15 and 17 extend in an axial direction 32 with respect to an included spanwise direction 31**.

Still referring to FIG. 3, as a result of the multiple stepped surfaces 13, 15 and 17, there is a corresponding reduction in the area of the distal end stripping surface 21 that contacts the surface of the paper sheet 30 as the paper sheet 30 moves across the distal end stripping surface 21 in the spanwise direction 31 after being stripped from the fuser roll 50.

Figure 4:
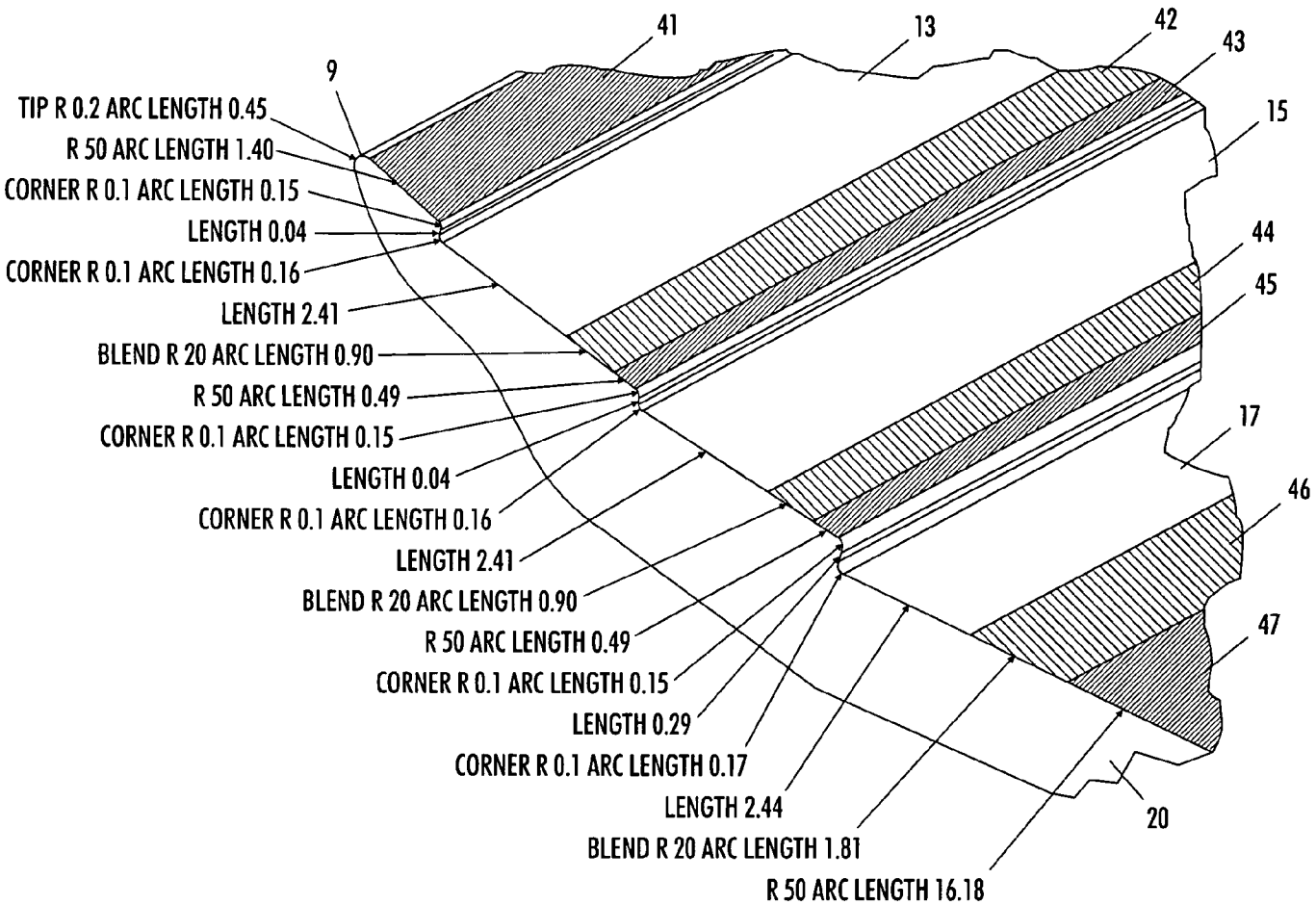
FIG. 4 is a detached elevated perspective view of the typical baffle finger **10.*n* of FIG. 3**. All dimensions are expressed in millimeters (mm).

Referring now to FIG. 4 there is shown further detail for the typical baffle finger **10.*n* of FIG. 3. As depicted, in one embodiment the curved surface 41, the curved surface 43, the curved surface 45 and the curved surface 47 are coincident with a cylinder whose axial radius is 50 mm. Also as depicted, in one embodiment each of the curved surface 42, the curved surface 44 and the curved surface 46 has a radius of 20 mm. Also as depicted, in one embodiment the corner radii common values of 0.1 mm are chosen for ease of extrusion in fabricating the fuser stripper baffle 20**.

Figure 5:
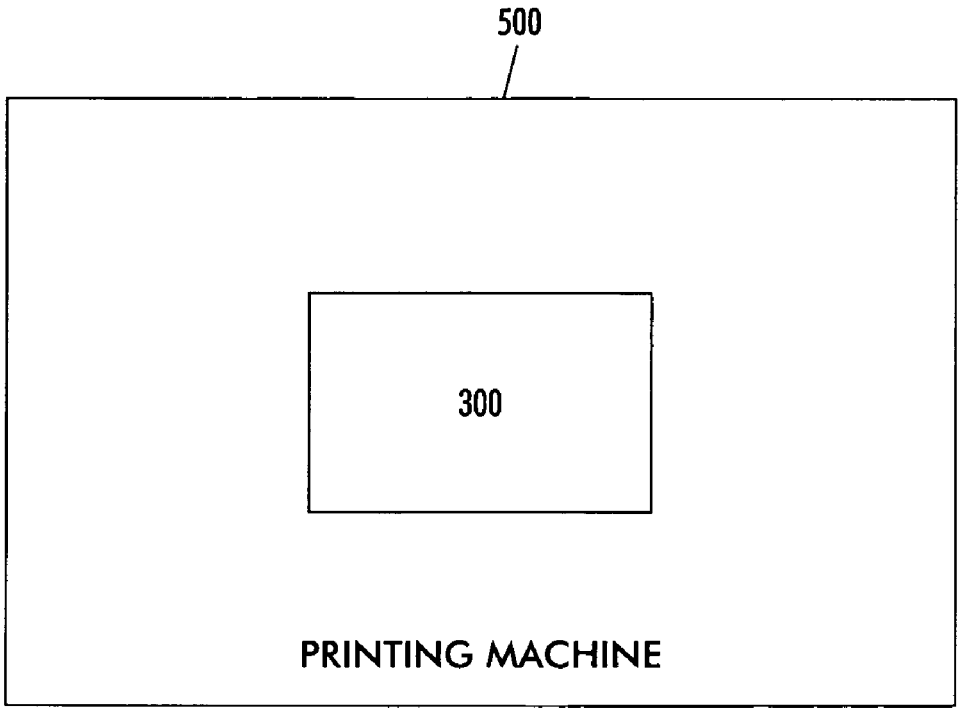
FIG. 5 is a block diagram depicting a xerographic printing machine 500 including the fuser stripper baffle 20 of FIG. 1 and the fuser roll 50.

Referring now to FIG. 5, there is shown a block diagram depicting a xerographic printing machine 500 including the fuser stripper baffle 20 and the fuser roll 50.

In one embodiment, the printing machine 500 comprises a copy machine.

In one embodiment, the printing machine 500 comprises a network printer.

Referring again generally to FIG. 1, as discussed above, the fuser stripper baffle 20 is depicted as comprising a multiplicity (N) of individual protruding baffle fingers 10 wherein N equals 7.

Still referring to FIG. 1, those skilled in the art will understand that in an alternate embodiment the fuser stripper baffle 20 comprises a multiplicity (N) of individual protruding baffle fingers 10 wherein N equals a value other than 7.

Thus, in one alternate embodiment, N equals a value less than 7 such as, for example, 6.

Further, in another alternate embodiment, N equals a value greater than 7 such as, for example, 8.

Referring again generally to FIGS. 1–4, in one embodiment the fuser stripper baffle 20 is comprised of extruded aluminum.

In summary, in accordance of the present invention, the amount of transfer, and the amount of gloss differential, is substantially reduced by stepping the stripping surface of the stripper baffle to reduce the area in contact with the image on the sheet. This rejection in heat transfer results in a reduced differential gloss on the image. Currently the steps or plateaus are extruded into the aluminum baffle and the openings for the stripper fingers are machined into the extrusion. The geometry of the steps is designed such that the paper as it is stripped from the fuser roll does not have a stub point.

Thus, there is proposed an exit baffle geometry that minimizes differential gloss marks due to paper contacting the fuser exit baffle. Portions of paper that touch the baffle cool differently than portions that don't, resulting in differential gloss in the paper path or spanwise direction. In accordance with the present invention, the exit baffle contains a series of axial-direction steps or plateaus in its upper surface, such that the highest step is nearest the fuser roll, while the lowest plateau is furthest from the roll. This ensures that the paper exiting the fuser rides only on the highest or nearest step, thereby touching the exit baffle for the minimum amount of time, thus minimizing the heat transfer to the baffle. This minimizes differential cooling effects which, in turn, minimizes differential gloss.

Thus there has been described the first aspect of the invention, namely, the fuser stripper baffle 20 comprising a multiplicity of protruding fingers 10.1 through 10.7, the multiplicity of fingers 10.1 through 10.7 arranged to strip a paper sheet 30 from a proximate fuser roll 50, each finger **10.*n* of the multiplicity of fingers 10.1 through 10.7 forming a protruding distal stripping end 9 and an adjacent upper distal end stripping surface 21, the distal end stripping surface 21 forming a multiplicity of stepped surfaces 13, 15 and 17, the multiplicity of stepped surfaces 13, 15 and 17 extending in an axial direction 32 with respect to an included spanwise direction 31**.

In one embodiment, the fuser stripper baffle 20 comprises exactly seven (7) fingers 10.1 through 10.7.

In one embodiment, the fuser stripper baffle 20 comprises exactly three (3) stepped surfaces 13, 15 and 17.

Also, there has been described the second aspect of the invention, namely, the printing machine 500 including the fuser stripper baffle 20, the fuser stripper baffle 20 comprising a multiplicity of protruding fingers 10.1 through 10.7, the multiplicity of fingers 10.1 through 10.7 arranged to strip a paper sheet 30 from an included proximate fuser roll 50, each finger **10.*n* of the multiplicity of fingers 10.1 through 10.7 forming a protruding distal stripping end 9 and an adjacent upper distal end stripping surface 21, the distal end stripping surface 21 forming a multiplicity of stepped surfaces 13, 15 and 17, the multiplicity of stepped surfaces 13, 15 and 17 extending in an axial direction 32 with respect to an included spanwise direction 31**.

In one embodiment, the printing machine 500 comprises a copy machine.

In one embodiment, the printing machine 500 comprises a network printer.

The table below lists the drawing element reference numbers together with their corresponding written description:

| Ref. No.: | Description: |
|---|---|
| 9 | baffle finger distal stripping end |
| 10.1–10.7 | individual baffle fingers |
| 10.n | typical baffle finger |
| 13 | first stepped surface or plateau |
| 15 | second stepped surface or plateau |
| 17 | third stepped surface or plateau |
| 19 | non-stepped upper surface of baffle finger |
| 20 | fuser stripper baffle |
| 21 | baffle finger distal end stripping surface |
| 30 | paper sheet |
| 31 | paper path travel or spanwise direction |
| 32 | axial direction |
| 41–47 | curved surfaces of the distal end stripping surface 21 |
| 50 | fuser roll |
| 51 | fuser roll rotation |
| 300 | arrangement of the fuser stripper baffle 20 and the fuser roll 50 |
| 500 | printing machine |

While various embodiments of a fuser stripper baffle and a printing machine including the same, in accordance with the present invention, are described above, the scope of the invention is defined by the following claims.

What is claimed is:

1. A fuser stripper baffle comprising a multiplicity of protruding fingers, the multiplicity of fingers arranged to strip a paper sheet from a proximate fuser roll, each finger of the multiplicity of fingers forming a protruding distal stripping end and an adjacent upper distal end stripping surface, the distal end stripping surface forming a multiplicity of stepped surfaces, the multiplicity of stepped surfaces extending in an axial direction with respect to an included spanwise direction.

2. The fuser stripper baffle of claim 1 comprising exactly seven (7) fingers.

3. The fuser stripper baffle of claim 2 comprising exactly three (3) stepped surfaces.

4. A printing machine including a fuser stripper baffle, the fuser stripper baffle comprising a multiplicity of protruding fingers, the multiplicity of fingers arranged to strip a paper sheet from an included proximate fuser roll, each finger of the multiplicity of fingers forming a protruding distal stripping end and an adjacent upper distal end stripping surface, the distal end stripping surface forming a multiplicity of stepped surfaces, the multiplicity of stepped surfaces extending in an axial direction with respect to an included spanwise direction.

5. The printing machine of claim 4, wherein the fuser stripper baffle comprises exactly seven (7) fingers.

6. The printing machine of claim 5, wherein each finger comprises exactly three (3) stepped surfaces.

7. The printing machine of claim 4 comprising a copy machine.

8. The printing machine of claim 4 comprising a network printer.

* * * * *